United States Patent [19]

Barwise et al.

[11] 4,266,675

[45] May 12, 1981

[54] OPTICAL WOOD-BARK SEGREGATOR

[75] Inventors: Robert D. Barwise, Bovey, Minn.; John A. Sturos, Laurium; Douglas B. Brumm, Calumet, both of Mich.

[73] Assignee: The United States of America as represented by the Secretary of Agriculture, Washington, D.C.

[21] Appl. No.: 109,590

[22] Filed: Jan. 4, 1980

[51] Int. Cl.[3] ..... B07C 5/342

[52] U.S. Cl. ..... 209/540; 209/588; 209/644; 250/223 R; 356/432

[58] Field of Search ..... 209/540, 545, 557, 576, 209/577, 588, 644, 544; 356/51, 432; 250/223 R

[56] References Cited

U.S. PATENT DOCUMENTS

| | | | |
|---|---|---|---|
| 2,351,702 | 6/1944 | Peterson | 209/588 |
| 3,496,366 | 2/1970 | Hunziker et al. | 250/223 R |
| 3,770,112 | 11/1973 | Asfour | 209/577 |
| 3,987,660 | 10/1976 | Pelanne | 356/432 X |
| 4,051,952 | 10/1977 | Hauptmann et al. | 209/588 X |

*Primary Examiner*—Joseph J. Rolla
*Attorney, Agent, or Firm*—M. Howard Silverstein; David G. McConnell

[57] ABSTRACT

A process of separating wood chips according to their bark content by orienting them between a light source and light detector, measuring the amount of light transmitted through each chip, and separating the bark-laden chips from the bark-free chips on the basis of their light transmittance. An apparatus for separating wood chips according to their bark content, comprising a light source, a light detector, means for properly orienting the wood chips between the light source and detector, and means for differentiating between bark-laden chips and bark-free chips on the basis of their light transmittance.

11 Claims, 8 Drawing Figures

OPTICAL WOOD-BARK SEGREGATOR

BACKGROUND OF THE INVENTION (1) Field of the Invention

The invention deals with the differentiation and segregation of wood fiber chips from bark fiber chips and wood-bark fiber chips.

(2) Description of the Prior Art

For our woodlands and forests to keep pace with the increasing demands of our society for more raw materials, more efficient utilization of the available wood fiber must be made.

One of the most efficient wood harvesting methods is total tree chipping, where the aboveground portion of the tree is reduced to wood chips, thin wood pieces of various widths and lengths. There are several stationary and portable whole-tree chippers commercially available, but none can debark the total tree prior to chipping. As a result, these chippers produce three types of chips: wood fiber chips, with no bark content; bark fiber chips, comprised solely of bark; and wood-bark fiber chips, comprised of both wood and bark.

There are several reasons for debarking wood fiber prior to utilization. The two most important are to increase the quality of wood fiber yield, and to remove contaminants such as rocks, dirt, grit, and soils, which are embedded in the bark during harvesting and transport. Formerly, debarking was done with axes, spuds, and draw knives. As technology progressed, machines replaced these hand tools. The mechanical debarkers are fairly efficient on stemwood, but cannot debark the limps and tops which can comprise up to 50 percent of the total tree fiber weight. If one adds to this the inherent inefficiency of present-day debarkers, it becomes apparent that an improved method of wood and bark separation is desirable.

For some products it is neither desirable nor necessary to remove the bark from the wood fiber. Bark in natural volumes is, however, intolerable in the manufacture of quality paper or chipboard products. The fact that "clean" wood fiber is desirable and that present-day technology is deficient in separating clean from bark-laden fiber provides the incentive for this invention.

SUMMARY OF THE INVENTION

The invention is a process of separating wood fiber chips from wood-bark fiber chips and bark fiber chips. The mixed wood chips are oriented in a detecting zone between a light source and a light-detecting means. A beam of light from the light source is then passed through the thickness of the wood chips. The light passing through the chips is detected by the light-detecting means. The chips then pass through a separating zone, which with the detecting zone constitute a straight path through which the wood chips travel. The wood fiber chips are separated from the bark-laden wood-bark fiber chips and bark fiber chips by causing the bark-laden chips to deviate from the straight path in response to the relative amount of light transmitted through the wood chips, the amount of light transmitted through the wood fiber chips being the greatest.

This separation is accomplished by an apparatus for differentiating between components of a mixture of wood chips comprising wood fiber chips, bark fiber chips, and wood-bark fiber chips. The apparatus includes light-source means and light-detecting means, adjacent to the light-source means, for detecting light from the light-source means. The apparatus has orienting means for orienting the wood chips in a manner that causes the wood chips to pass in a straight path between the light-source means and the light-detecting means so that light is transmitted from the light source through each wood chip to the light-detecting means. In addition, the apparatus has differentiating means for differentiating between light transmitted through the wood fiber chips, wood-bark fiber chips, and bark fiber chips.

The apparatus can also be used without a separating means to determine the percentage of wood fiber chips in the total mixture.

The wood chips, after passing through the apparatus, are divided into two groups, one consisting of wood fiber chips and the other consisting of bark fiber and wood-bark fiber chips. The wood fiber chip fraction is suitable for use in products that cannot tolerate significant bark impurities. Accordingly, an object of this invention is a method of scanning a flow of wood chips with light to identify the constituent fibers as bark or wood. A further object of this invention is a method of separating the identified wood chips. A still further object of the invention is to provide a method of furnishing a volume of wood fiber chips with controlled bark content conducive to the manufacture of a quality product. A final object of the invention is to provide a quality control system to monitor the bark content of a chip mixture.

DESCRIPTION OF THE PREFERRED EMBODIMENTS

The observation that wood in chip form is translucent, or able to transmit light, while bark is not, forms the basis of this invention. The inventors' experiments showed a substantial difference in the amount of light detected by a light-sensitive device when a beam of light was passed through a wood fiber chip as compared to that same beam of light passed through a bark fiber chip. This substantial difference, due to differences in the resistance of bark and wood to light penetration, triggers the removal of bark fiber chips with an air source.

When the wood chip passes through the detecting zone, comprising the light source transmitting light to a light detector and that light detector, the drop in the intensity of light transmitted to the detector causes a change in the electrical current in the light detector's electrical sensing circuit. The degree of change is inversely proportional to the translucence of the fiber; a translucent wood fiber chip will cause both a much smaller change in light transmitted to the detector and a much smaller drop in the electrical current than will a less translucent bark fiber chip. Each sensing circuit is set to activate a signal at a predetermined electrical current level. That level is set such that substantially all of the wood fiber chips will not cause a drop below the predetermined level and such that substantially all of the bark fiber or wood-bark fiber chips will cause a drop below the predetermined level. Thus, upon the passing of a bark fiber chip or wood-bark fiber chip through the detecting zone, the electrical current falls below the predetermined level. The sensing circuit then transmits a signal to the air valve causing it to open long enough to emit a blast of air through the air nozzle. This blast of air is directed perpendicularly to the straight path of the falling wood chips and is of sufficient intensity to deflect the bark fiber chip or wood-bark fiber chip into a collector.

Upon the passing of a wood fiber chip through the detecting zone, the electrical current does not fall below the predetermined level because of the wood fiber chip's translucence and no signal is transmitted to the air valve. The wood fiber chip thus continues its gravity drop into a second collector.

Figure 1:
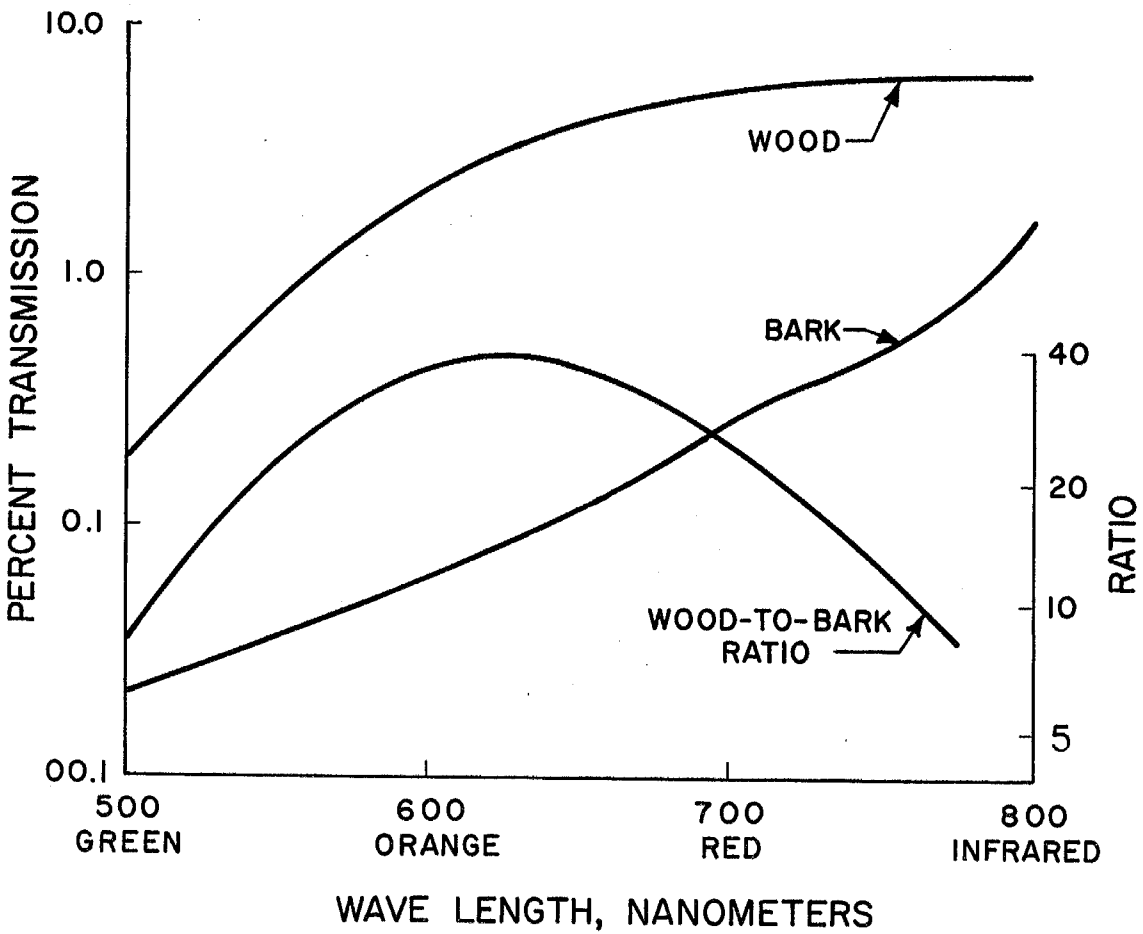
FIG. 1 is a graph of percent transmission and spectral transmittance ratio vs. wavelength for aspen.
Figure 2:
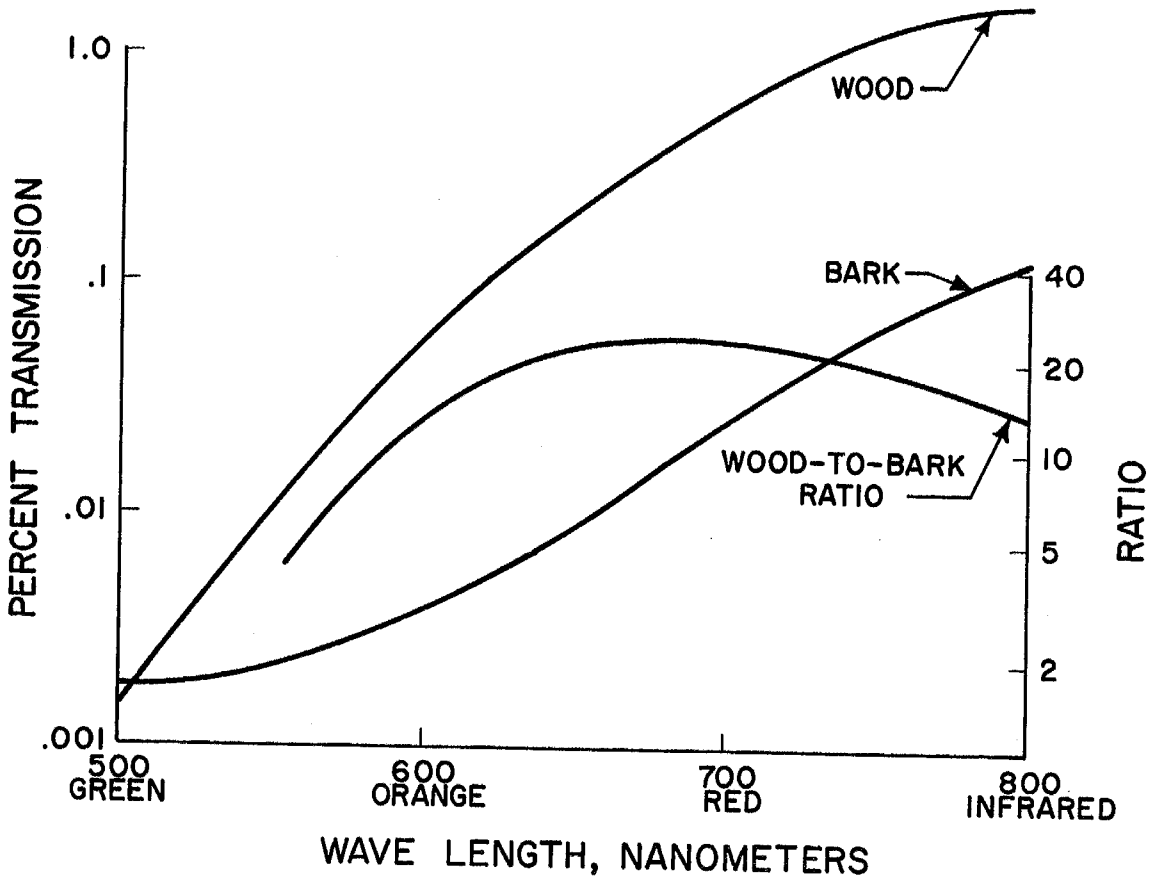
FIG. 2 is a graph of percent transmission and spectral transmittance vs. wavelength for maple.

Spectral transmittance is a measurement of the amount of light that is passed through matter. Spectral transmittance measurements on randomly selected bark and wood chips of various species have shown that both have their highest transmittance in the red and infrared regions of the spectrum. Referring now to the drawings, FIGS. 1 and 2 show average spectral characteristics for aspen and maple, respectively. Note that the bark and wood curves do not have the same shapes. In addition to the transmittance curve, the wood-to-bark transmittance ratio is shown as a function of wavelength for each species. This ratio is known as the spectral transmittance ratio (STR). The curve of wood-to-bark transmittance ratio can be used to select optimum wavelength range for the best segregation for a given species by selecting the point where the STR is highest.

The inventors observed that at certain light wavelengths, the STR for the wood species tested is as high as 50. This STR peaks at different light wavelengths for different species of wood. Utilizing the wavelength of light giving the highest STR increases the likelihood that a flake will be properly classified. A smaller STR would result in more misclassification for those fibers which transmit an amount of light between that transmitted by most wood fiber chips and that transmitted by most bark and wood-bark fiber chips.

Two basic schemes of photosorting could be used. A white light source, emitting light of various wavelengths between 385 and 760 nanometers, would result in adequate separation of the chips if the wood-to-bark transmittance ratio in this range was high. If, for example, the light-sensitive device detecting the amount of light transmitted through a fiber was only sensitive to light wavelengths between 500 and 760 nanometers, FIG. 1 indicates that the wood-to-bark ratio for aspen would be sufficiently high throughout the light-sensitive device's sensitive range to facilitate good separation with white light.

Some wood species do not have desirable, well-separated wood- and bark-transmittance curves, resulting in low STRs at many light wavelengths. With these species, it may be necessary to exploit the difference in the shape of the curves by using a narrow-band light source at the wavelength where the STR is highest. A narrow-band light source could be a color-filtered white light or a laser. Use of the narrow-band light source would be more selective than the overall transmittance method wherein white light is used, provided the bark and wood transmittance curves do not have identical shapes.

Nondebarked trees or tree sections are chipped in portable or stationary commercial tree chippers. As example of a portable tree chipper is the Morbark 22L portable whole-tree chipper, manufactured by Morbark, Inc., Winn, Mich. These tree chippers produce wood chips in the preferred thickness range of 0.100 to 0.250 inch or the operable thickness range of 0.040 to 0.500 inch.

Referring now to FIGS. 3, 4, 5, and 6, the preferred embodiment of the present invention is substantially enclosed and supported by a frame 34 having an outer wall 35 and base 16. Wall 35 includes an opening 51 near the bottom thereof to permit wood chips to leave the structure. A deflector blade 41 connected to wall 35 at opening 51, and projecting inward from such opening, directs the chips through the opening onto discharge conveyor 43, as will be later more fully explained. Attached to the base 16 of frame 34 and projecting upward therefrom is a stationary vertical center shaft 40.

Figure 4:
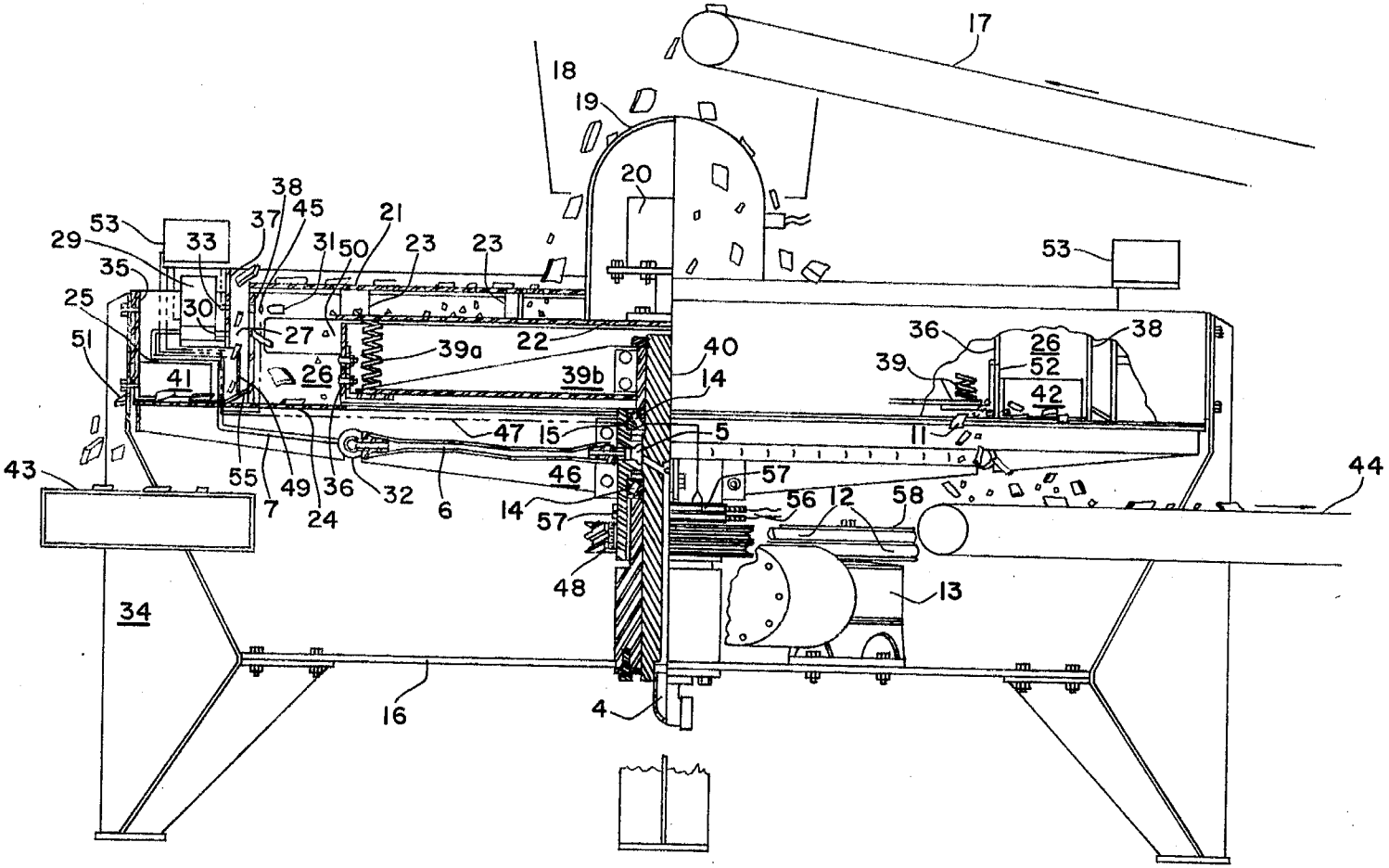
FIG. 4 is a side elevation view of the optical wood-bark segregator shown in FIG. 3.
Figure 6:
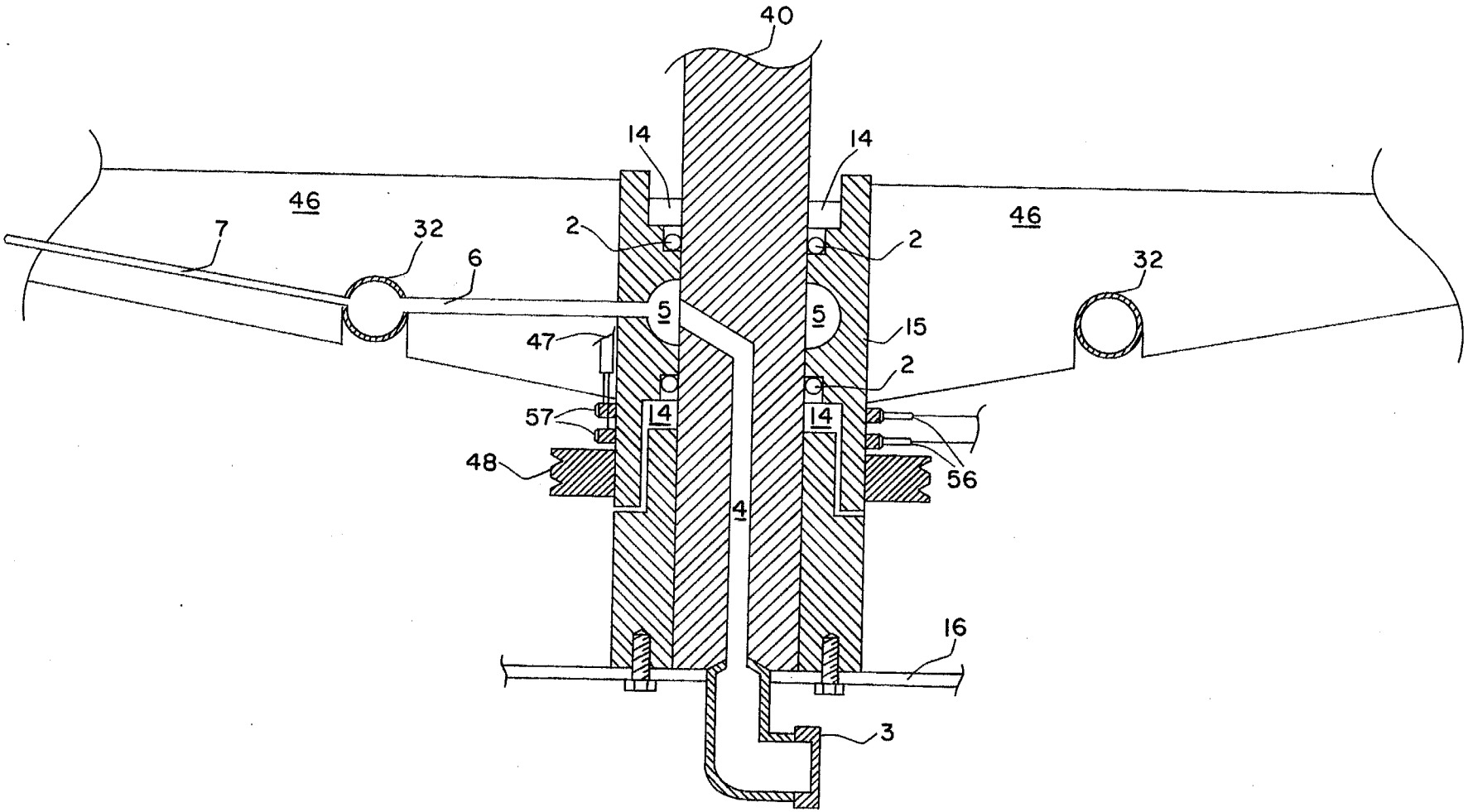
FIG. 6 is a section view of a rotative mechanism for an optical wood-bark segregator.

As seen in FIGS. 4 and 6, a rotating assembly 15 is rotatably connected to stationary shaft 40. Such assembly rotates around shaft 40 and is supported by bearings 14 which in turn are fixed to shaft 40. Drive assembly 48 is fixed to rotating assembly 15 and is connected to an electric motor 13 by means of pulley assembly 58 and belts 12.

A plurality of support arms 46 are fixed to and rotate with rotating assembly 15. A ring-shaped plate 24 is connected to and supported by the top of the arms and rotates therewith. Shaft 40 and the inner rim of plate 24 define a passageway 11 therebetween to permit bark and residue to be deflected off of plate 24 onto discharge conveyor 44, as will be later more fully explained. Plate 24 includes concentric walls 37 and 38 attached to the top thereof, which walls rotate along with plate 24.

Connected to the upper part of the shaft 40 are a plurality of stationary arms **39*b*. Fixed to the extremities of the arms is a stationary wall 36 concentric with shaft 40. Wall 36 includes an opening 52 in the bottom thereof to permit bark chips and other residue to exit from the structure. A deflector blade 42 connected to wall 36 at opening 52, and projecting outward from such opening, directs material through the opening and subsequently onto discharge conveyor 44**, as will be later more fully explained.

Spaced above the shaft 40 is a horizontal plate 22 having a plurality of legs **39*a* in the form of springs attached to the underside thereof. The lower ends of the springs are connected to arms 39*b***.

A vibrating mechanism 20 is mounted in the center of plate 22 and imparts a vibrating movement thereto. Ring shaped plate 21 is rigidly mounted above plate 22 by means of a plurality of posts 23 so that plates 21 and 22 vibrate together. The periphery of plate 21 extends to a point immediately above wall 38. Plate 21 also contains a plurality of perforations 54 of a size and number suitable to allow contaminants such as dirt, soils, and small bark fiber chips to fall through to plate 22. Dome 19 is mounted on plate 22 so that it encloses vibrating mechanism 20 and extends through ring-shaped plate 21 where it functions to distribute the wood chip mixture as it enters the segregator.

Figure 3:
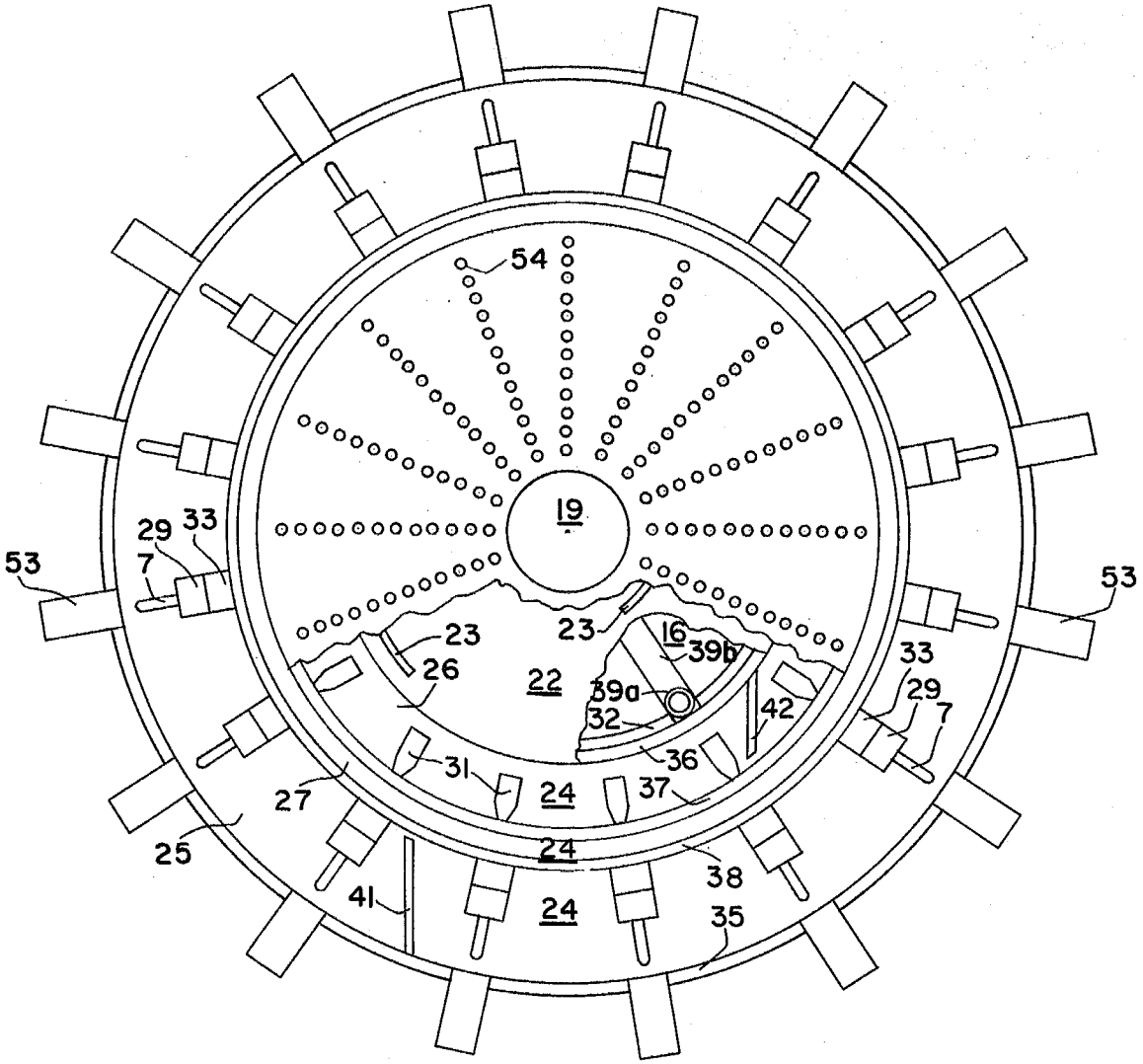
FIG. 3 is an overhead plan view of an optical wood-bark segregator.
Figure 7:
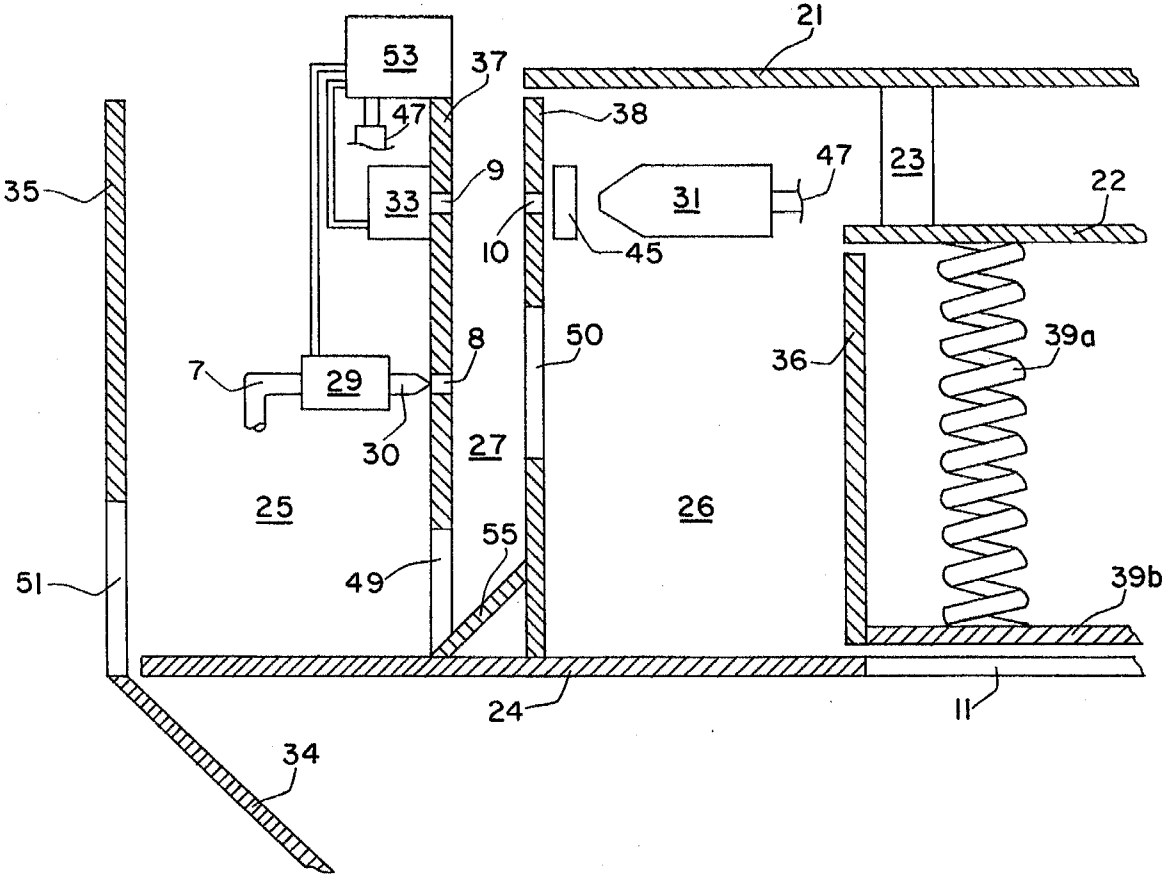
FIG. 7 is a schematic view of the wood-bark segregating mechanism.

As shown in FIGS. 3 and 7, ring-shaped plate 24 comprises the floor of three concentric compartments. Outer compartment 25 is formed between stationary outer wall 35 and rotating wall 37. Inner compartment 26 is formed between rotating wall 38 and stationary wall 36. Intermediate compartment 27 is formed between rotating wall 37 and rotating wall 38. Walls 37 and 38 are preferably spaced apart just enough so that intermediate compartment 27 will be a width sufficient to allow only a single layer of wood chips to pass therebetween. Wall 37 has a plurality of openings 49 at the bottom thereof to permit clean wood fiber chips to exit from compartment 27.

A baffle 55 attached at one end to wall 38 and extending at an angle across compartment 27 at the bottom of opening 49 facilitates the exit of the chips from compartment 27.

Also shown in FIG. 7 is a set of optical means of the present invention. Included therewith is a light source 31 mounted on wall 38 within compartment 26 adjacent a hole 10 in wall 38. Opposite each such hole 10 is a hole 9 in wall 37. Adjacent each hole 9 in wall 37 is a light detector 33 connected to wall 37 within compartment 25. Typically, a sufficient number of light-detecting means 33, light sources 31, and associated equipment are supplied so that when the scanning assembly is rotated by drive assembly 48 at a specific speed, a positive scan is made of each wood chip after said wood chip leaves the periphery of screen 21.

When activated, light rays from each light source 31 pass through hole 10 in wall 38, then through compartment 27, and finally through hole 9 in wall 37 to light detector 33. Suitable light source include incandescent quartz-halogen slide projector lamps such as type ELB, 30 V, 80 W lamps. Suitable detectors are comprised of silicon phototransistors such as Fairchild FPA 700A. A typical detector may contain nine separate phototransistors spaced on 0.1-inch centers in a molded opaque epoxy module with clear windows.

Lenses and filters 45 may be positioned between the light source and detectors to aid in directing light in the proper direction and to provide light of the wavelength that will result in the largest STR as discussed previously. Suitable lenses and filters will be known to those skilled in the art.

Positioned below each detector 33 in compartment 25 is an air nozzle 30 supported by wall 37. At the proper time, each nozzle injects a stream of air into compartment 27 via hole 8 in wall 37. The air stream passes through compartment 27 in the direction of window 50 in opposite wall 38.

The passage of air through each nozzle 30 is controlled by an electrically activated valve 29 disposed in air line 7 connected to each nozzle. Each valve is electrically connected to a respective control box 53 mounted on wall 37, which boxes contain photosorting circuitry. In turn, control box 53 is electrically connected to a respective light detector 33.

Referring again to FIG. 6, it can be seen that each air line 7 receives air from manifold 32 which is an annular tube supported by arms 46. Manifold 32 is connected through one or more tubes 6 to annular plenum 5 located within rotating assembly 15 and surrounding stationary shaft 40. Shaft 40 has within it an air passage 4 which communcates at one end with annular plenum 5 and at the other end with connector 3 beneath the base 16 of frame 34.

Seals 2 surrounding shaft 40, which are located above and below annular plenum 5, prevent leakage of air. Electrical power for light sources 31, detector 33, valves 29, and control boxes 53 is supplied through brushes 56, tracks 57, and electrical lines 47.

Figure 8:
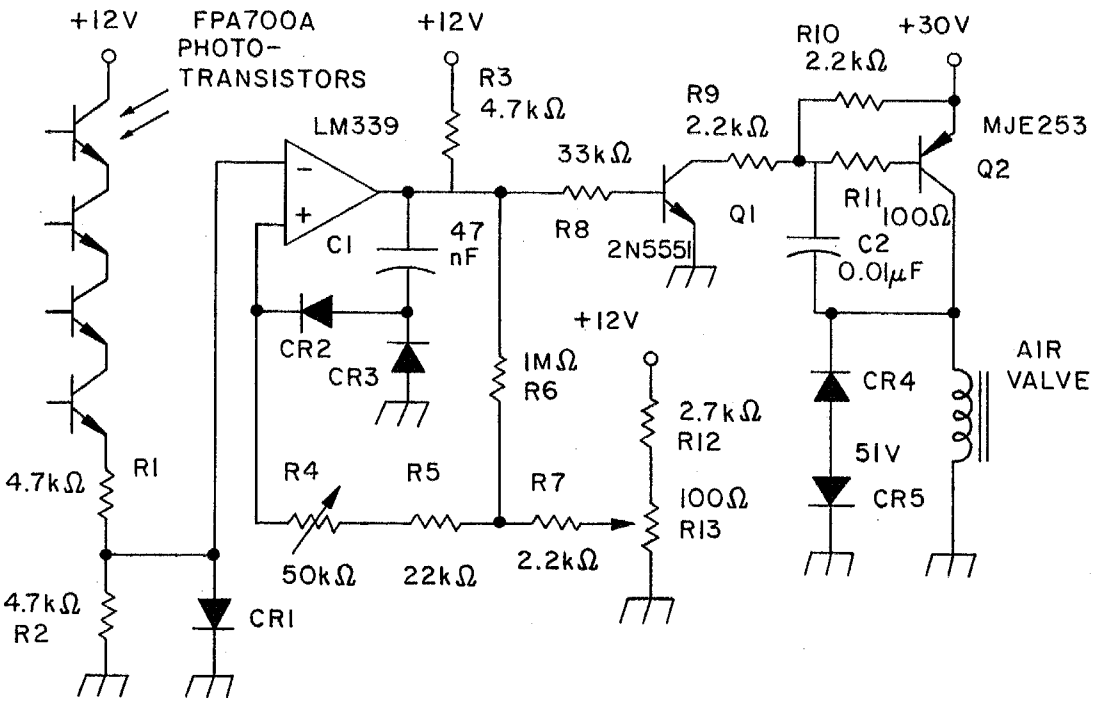
FIG. 8 is an electrical diagram of a photosorting circuit.

In one embodiment of the instant invention the photosorter circuit comprises an integrated circuit comparator (LM339) that detects whether or not the current in a series array of phototransistors is above or below a threshold level, FIG. 8. The comparator is followed by a two-stage amplifier that drives the air-valve coil (Q1 and Q2).

The photocurrent generated in the phototransistor array enters the circuit through R1 and flows through R2 and CR1. The voltage across R2 is applied to the inverting input of the comparator. This voltage is then compared with an adjustable threshold old voltage applied to the noninverting input. The threshold or reference voltage is produced at the wiper of R13 and is fed to the comparator's noninverting input through R4, 5, and 7.

When the phototransistors are illuminated, the voltage across R2 is higher than the threshold, causing the comparator output to be low. Q1 and Q2 are then both off, the air-valve current is zero, and the air valve is closed. If the light falling on any one phototransistor in the series-connected array is reduced, that transistor will tend to turn off, reducing the current flowing in the string. A sufficient reduction will decrease the voltage across R2 until it becomes smaller than the threshold voltage. This causes the comparator output to go high which will then permit base current to flow into Q1 through R8, turning Q1 on. With Q1 on, current can flow through the emitter-base junction of Q2, through R9, and into the collector of Q1. This current will turn Q2 on, energizing the air valve.

Restoring the irradiance on all the phototransistors will cause the voltage across R2 to rise above the threshold, reversing the entire process and turning the valve off. Thus, with proper adjustment, the wood chips transmit sufficient light to pass over the system with no effect while bark chips, having a higher optical density, will trigger the comparator and be ejected by a burst of air.

It is desirable to have some hysteresis in the comparator threshold voltage to promote faster switching, to reduce the susceptibility to noise, and to prevent oscillations during the state change. Hysteresis of about 25 millivolts is provided by resistors R6 and 7. If the input current decreases enough to switch the comparator, its output goes high—from nearly zero to about 12 volts. The voltage divider formed by R6 and R7 then adds a fraction to this 12 volt change to the voltage at the wiper of R13 and applies it to the noninverting comparator input through R4 and 5. Thus, positive feedback aids the transistion, causing rapid comparator switching even if the input voltage is changing slowly. When the voltage across R2 rises above this higher threshold voltage, the comparator output goes low, reversing the process and reestablishing the original lower threshold voltage. The hysteresis can readily be changed by changing R6 or 7.

To achieve high speed, the air-valve coil, which is rated at 12 volts, is driven by a higher voltage, typically about 30 volts. The increased voltage causes a more rapid current rise in the coil when Q2 turns on, producing a more rapid pull-in of the valve armature. The duty cycle of the valve is low enough to prevent overheating of the coil.

Rapid turn off of the air valve is just as important as rapid turn on. This is achieved by dumping the energy stored in the coil's magnetic field into the zener diode CR5. When Q2 turns off the coil current must be provided an alternate path or excessive voltage will be applied to Q2 due to the inductance of the coil. This path is provided by CR4 and 5. The maximum voltage applied across Q2 is thus limited to the sum of the zener voltage and the supply voltage.

In order to eject a chip, it is necessary that Q2 remain on long enough for the air valve to completely open. Thus, it is necessary to provide for a certain minimum on-time of the comparator. The circuit comprising CR2, 3, C1, R4, and 5 performs this function. When the comparator output goes high, the output voltage change is coupled to the noninverting comparator input by C1 through CR2. This forces the comparator to remain in its high-output state until C1 charges through R4, 5, and 7. Diode CR1 limits the maximum voltage at the inverting input; when the voltage at the noninverting input falls below this value the comparator reverts to its low-output state and C1 discharges rapidly through CR3. Potentiometer R4 permits adjustment of the time constant to match the particular valve being used.

The sensitivity of the overall circuit can be changed by modifying the value of R2, by adjusting the threshold voltage with R13, or by changing the brightness of the light source illuminating the chips. Large sensitivity adjustments should be made by changing R2 while R13 is most useful for balancing or matching the sensitivity of the various channels of the system. The voltage at the wiper of R13 should generally be 200 to 300 millivolts. The voltage applied to the illuminating lamp (or lamps) is then used for changing the segregation threshold or for different species.

Figure 5:
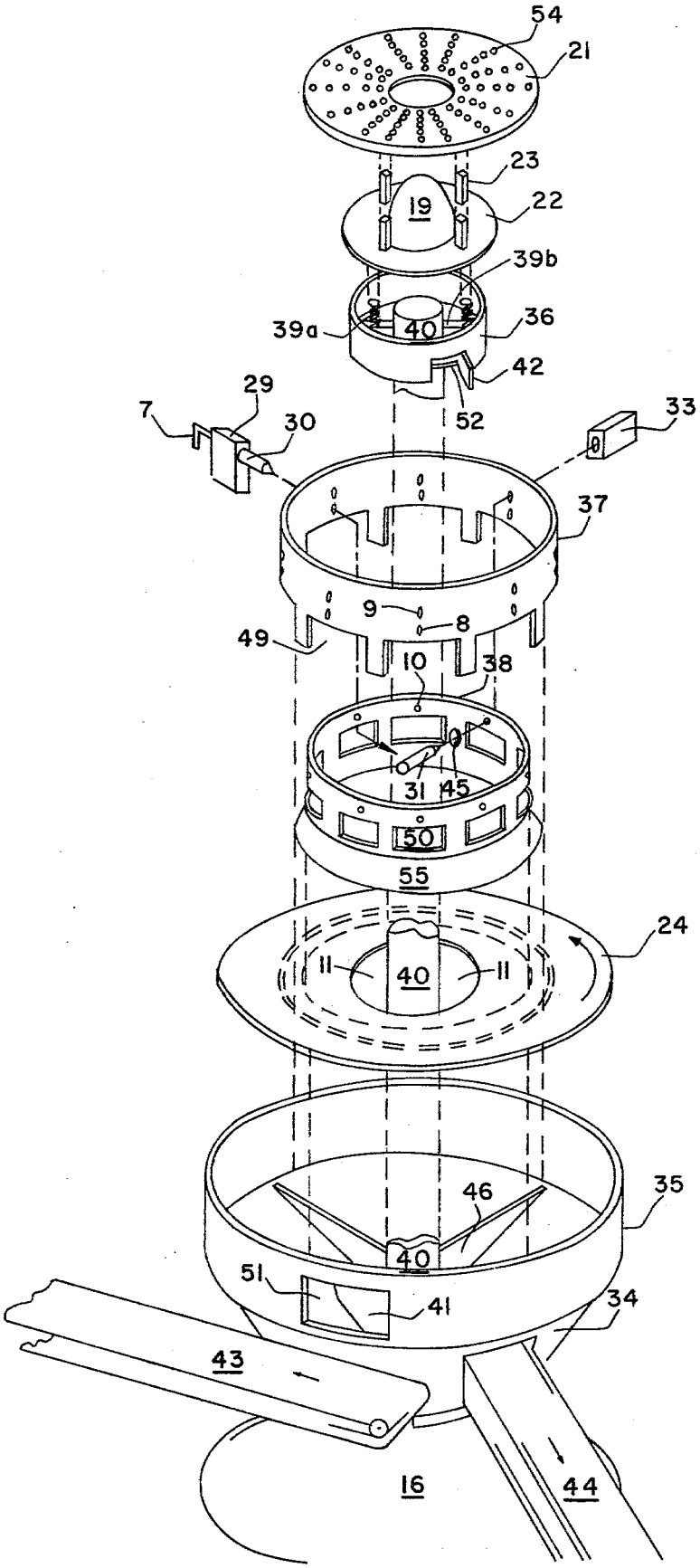
FIG. 5 is an exploded view of an optical wood-bark segregator.

The operation of the unit will now be described. Referring to FIGS. 4 and 5, chips are place on conveyor 17 for transfer to hopper 18. Hopper 18 acts as a surge bin and is designed to feed a continuous flow of chips onto vibrating dome 19. The dome, in turn, evenly distributes the chips onto vibrating perforated plate 21 across its 360 degree periphery. Undesirable contaminants in the mixture, such as dirt, soils, and small bark fiber chips, fall through perforations 54 onto vibrating plate 22.

The material on plate 22 then traverses the radius of the plate and falls into inner compartment 26 and onto rotating plate 24 at the bottom thereof. The material is then carried along by plate 24 until it is caught against stationary deflector blade 42 attached to stationary wall 36, which blade directs the material inwardly in the direction of shaft 40. Such material then passes through opening 52 in wall 36 and then through passageway 11 between shaft 40 and the inner rim of plate 24. After falling through the passageway 11, the material is caught on discharge conveyor 44.

Chips not passing through perforations 54 in plate 21 traverse the radius of vibrating plate 21 and fall into intermediate compartment 27. As the chips fall by gravity through compartment 27, they pass between light sources 31 and detectors 33. Whenever a bark chip (as opposed to a wood chip) passes between a light source and respective detector, the control circuit is activated as explained earlier, i.e., control box 53 activates its respective air nozzle in time to blast said bark chip out of chamber 27 through window 50 into chamber 26 onto rotating plate 24. Bark chips thereafter leaves the apparatus in the same manner as described for other materials in chamber 26.

Wood fiber chips passing between a light source and detector do not activate the nozzle, and therefore fall toward the bottom of intermediate compartment 27. Upon nearing the floor, they are deflected by baffle 55 towards doorways 49 in wall 37, and thereafter carried by inertia and centrifugal force through such doorways to land on plate 24 in outer compartment 25. From there, the wood chips are carried along by rotating plate 24 until caught against stationary deflector blade 41 on outer wall 35 of frame 34. Upon reaching blade 41, the wood fiber chips are deflected thereby through opening 51 in the bottom of outer wall 35 and then onto discharge conveyor 43.

Having disclosed our invention, we claim:

1. A process of separating wood fiber chips from wood-bark fiber chips and bark fiber chips comprising:
   a. orienting a mixture of wood chips comprising wood fiber chips, wood-bark fiber chips, and bark fiber chips in a detecting zone between a light source and a light-detecting means;
   b. transmitting a beam of light from said light source through the thickness of said wood chips and detecting said beam of light with said light-detecting means;
   c. passing said wood chips through a separating zone where said separating zone and said detecting zone constitute a straight path for said wood chips to travel;
   d. separating said wood fiber chips from said wood-bark fiber chips and said bark fiber chips by causing said wood-bark fiber chips and said bark fiber chips to deviate from said straight path in response to the relative amount of light transmitted through said wood chips, the amount of light transmitted through said wood fiber chips being the greatest.

2. The process of claim 1 wherein the wood chips are subjected to a preseparation prior to the orienting step to remove contaminants such as dirt, grit, soils, and small bark fiber chips.

3. The process of claim 1 wherein the wood chips are caused to travel through the straight path by gravity.

4. The process of claim 1 wherein the wood-bark fiber chips and the bark fiber chips are caused to be deflected from the straight path by a blast of air directed perpendicularly to said straight path.

5. An apparatus for differentiating between components of a mixture of wood chips comprising wood fiber chips, bark fiber chips, and wood-bark fiber chips comprising:
   a. light-source means;
   b. detecting means adjacent said light-source means for detecting light from said light-source means;
   c. means for orienting said wood chips comprising an intermediate compartment having a first wall and a second wall, said first and second walls being spaced apart so as to allow a single layer of wood chips to pass in a straight path between, each of said walls having a plurality of holes positioned so that light will pass through a hole in said second wall, through each wood chip in said intermediate compartment, through a hole in said first wall, and to said detecting means; and d. differentiating means connected to said detecting means for differentiating between light transmitted through the wood fiber chips, wood-bark fiber chips, and bark fiber chips.

6. An apparatus as described in claim 5 further comprising a preseparation means adjacent the upstream end of said orienting means for removing contaminants contained in said wood chips before said wood chips pass through said orienting means.

7. An apparatus as described in claim 5 further comprising a separating means for separating said wood fiber chips from said wood-bark fiber chips and said bark fiber chips in response to said differentiating means, said separating means being adjacent the downstream end of said orienting means.

8. An apparatus as described in claim 5 wherein the light-source means comprises a plurality of light sources mounted on the outside of said second wall, and wherein the detecting means comprises a number of light detectors equal to the number of light sources mounted on the outside of said first wall.

9. An apparatus as described in claim 8 wherein the separating means comprises a first plurality of openings in the second wall immediately below said light sources, said openings being equal in number to the number of light sources and larger than the wood chips; a plurality of air nozzles mounted in the first wall directly opposite said first openings; and means connected to said air nozzles and differentiating means for creating an air blast in response to said differentiating means when bark fiber chips and wood-bark fiber chips are detected by said detecting means.

10. An apparatus as described in claim 9 further comprising a frame assembly, a center support rigidly attached to said frame assembly, a circular ring plate rotatably attached to said center support to which the first and second walls are concentrically attached, said first wall having at the bottom a second plurality of openings through which the wood fiber chips are removed from the intermediate compartment, means for rotating said circular ring plate, a first collecting means adjacent said second plurality of openings for collecting said wood fiber chips, and a second collecting means adjacent said first plurality of openings for collecting said wood-bark fiber chips and said bark fiber chips.

11. An apparatus as described in claim 10 further comprising a preseparation means for removing contaminants contained in the wood chips wherein said preseparation means comprises a circular vibrating screen having perforations and a peripheral edge that in adjacent to said intermediate compartment, a vibrating plate positioned below and attached to said circular vibrating screen, said vibrating plate being concentrically attached rigidly to said center support, and a vibrating means attached to said circular vibrating screen and said vibrating plate to vibrate said circular vibrating screen and said vibrating plate.

* * * * *